US005837130A

United States Patent [19]

Crossland

[11] Patent Number: 5,837,130

[45] Date of Patent: Nov. 17, 1998

[54] CATALYTIC DISTILLATION REFINING

[75] Inventor: Clifford S. Crossland, Pasenda, Tex.

[73] Assignee: Catalytic Distillation Technologies, Pasadena, Tex.

[21] Appl. No.: 735,234

[22] Filed: Oct. 22, 1996

[51] Int. Cl.[6] ..... C10G 25/00

[52] U.S. Cl. ..... 208/213; 208/208 R; 208/209; 208/210; 208/218; 208/227; 208/212; 208/213; 208/348; 208/369

[58] Field of Search ..... 208/208 R, 213, 208/209, 210, 218, 227, 212, 348, 364

[56] References Cited

U.S. PATENT DOCUMENTS

| | | | |
|---|---|---|---|
| 3,671,603 | 6/1972 | Hagemeyer et al. | 260/677 |
| 3,699,036 | 10/1972 | Hass et al. | 208/11 |
| 3,884,984 | 5/1975 | Hirose et al. | 260/634 |
| 4,055,483 | 10/1977 | Mertzweiller et al. | 208/213 |
| 4,123,502 | 10/1978 | Höleter et al. | 423/230 |
| 4,194,964 | 3/1980 | Chen et al. | 208/108 |
| 4,213,847 | 7/1980 | Chen et al. | 208/111 |
| 4,232,177 | 11/1980 | Smith, Jr. | 585/324 |
| 4,451,607 | 5/1984 | Garcia et al. | 524/494 |
| 4,486,297 | 12/1984 | Matsumota et al. | 208/211 |
| 4,676,887 | 6/1987 | Fischer et al. | 208/61 |
| 4,690,806 | 9/1987 | Schorfheide | 423/230 |
| 4,731,229 | 3/1988 | Sperandio | 422/188 |
| 4,827,076 | 5/1989 | Kokayeff et al. | 585/737 |
| 4,941,968 | 7/1990 | Reid | 208/236 |
| 4,990,242 | 2/1991 | Louie et al. | 208/218 |
| 5,009,770 | 4/1991 | Muller et al. | 208/209 |
| 5,073,236 | 12/1991 | Gelbein et al. | 203/29 |
| 5,084,259 | 1/1992 | Satek et al. | 423/277 |
| 5,124,027 | 6/1992 | Beaton et al. | 208/309 |
| 5,154,817 | 10/1992 | Reid | 208/48 |
| 5,173,173 | 12/1992 | Vauk | 208/91 |
| 5,266,546 | 11/1993 | Hearn | 502/300 |
| 5,290,427 | 3/1994 | Fletcher et al. | 208/89 |
| 5,320,742 | 6/1994 | Fletcher et al. | 208/89 |
| 5,321,163 | 6/1994 | Hickey et al. | 568/59 |
| 5,322,615 | 6/1994 | Holtermann et al. | 208/91 |
| 5,348,641 | 9/1994 | Shih | 208/89 |
| 5,431,888 | 7/1995 | Hickey et al. | 422/191 |
| 5,431,890 | 7/1995 | Crossland et al. | 422/211 |
| 5,510,568 | 4/1996 | Hearn | 585/850 |
| 5,597,476 | 1/1997 | Hearn et al. | 208/208 R |

*Primary Examiner*—Helane Myers
*Attorney, Agent, or Firm*—Kenneth H. Johnson

[57] ABSTRACT

A process for hydrotreating petroleum fractions early in the refining process by employing catalyst prepared as components of distillation structures or as contained beds of catalyst in atmospheric distillation columns and or side draw columns. For example, a crude petroleum is hydrotreated by taking side streams from an atmospheric distillation column and the vacuum gas oil from a vacuum distillation column which are individually fed to separate desulfurizations, preferably in distillation column reactors containing a hydrodesulfurization catalyst. The overheads from each of the distillation column reactors is returned to the atmospheric column and the bottoms from each distillation column reactor is withdrawn as hydrotreated product. The process may also be used for upgrading the effluent from a fluid catalytic cracking unit, preferably operated as a catalytic distillation reactor.

22 Claims, 4 Drawing Sheets

FCCU
300
11
301
302
303
304
311
311a
311b
312
313
314
315
340
342
344
346
348
350
352
354
356
380
382
384
386
402
403

CATALYTIC DISTILLATION REFINING

BACKGROUND OF THE INVENTION

1. Field of the Invention

The present invention relates to processing of crude petroleum streams to upgrade various fractions derived from the initial crude distillation unit by hydrodesulfurizing the fractions and separation and recovery of the $H_2S$ produced in the hydrodesulfurizations.

2. Related Information

Crude petroleum streams contain a variety of organic chemical components. Generally the crude petroleum streams are processed in a refinery after some preliminary treatments in a crude distillation unit which comprises a first distillation column which operates at atmospheric pressure and a second distillation column which operates at a reduced pressure. The first distillation column is nominated the atmospheric column and the second the vacuum column.

At temperatures above about 650° F. components of the crude oil begins to undergo uncontrolled breakdown and cracking. To avoid this in the initial distillation two columns are used with the maximum preheater temperature for each column being about 650–750° F. The first or atmospheric column is operated at near to atmospheric pressure at crude furnace temperature of about 650–750° F. to remove various lighter components by distillation to fractionate the crude into useful cuts. The bottoms from the atmospheric column are fed to the vacuum distillation column through the vacuum heater.

During the operation of the two columns selected side streams are taken from the columns at different heights along the column. The higher the point of withdrawal the lower the boiling range which becomes the definitive characteristic of the stream. Typically the overheads are generally the $C_4$ and lighter components, with the second stream being naphtha, the third stream being kerosine/jet fuel/diesel and the fourth stream being atmospheric gas oil. Generally side streams are taken from the vacuum column for further processing and for specialty purposes such as lubricating oils.

The vacuum gas oil can be combined and hydrotreated and fed to a fluid catalytic cracking unit (FCCU) to crack the hydrocarbons contained therein to smaller chained hydrocarbons, especially gasoline boiling range and heating oil. Hydrotreating prior to cracking is considered beneficial in gasoline is improved and a considerable amount of the sulfur will be removed which reduces $SO_2$ emissions from FCCU itself.

The products from the fluid catalytic cracking reactor are all in the vapor phase due to the high temperatures involved and are thus condensed and fed to the recovery section. The FCCU product recovery section basically comprises an atmospheric distillation column similar to the one used in a crude distillation unit and several other gas ($C_4$ and lighter) columns. The primary FCCU distillation column produces several side streams similar in respect to those of the crude distillation unit.

Each side stream is then processed according to the crude source and products desired. The streams from particularly high sulfur crude sources must be hydrotreated to remove sulfur which may be catalyst poisons in further down stream processing or form polluting sulfur dioxides if the streams are used for fuels.

Organic sulfur compounds present in these petroleum fractions are denoted as, "sulfur". The amount of sulfur is generally dependent upon the crude source. For instance the Saudi Arabian crudes are generally high in sulfur as are certain domestic crudes. Kuwaiti, Libyan and Louisiana crudes are generally low in sulfur. The type of sulfur compounds will also depend on the boiling range of a given stream. Generally the lower boiling fractions contain mercaptans while the heavier boiling fractions contain thiophenic and heterocyclic sulfur compounds.

The organic sulfur compounds are almost always considered to be contaminants. They hinder in downstream processing and at the very least make obnoxious $SO_2$ gas when burned. For these reasons it is very desirable to remove these compounds. The degree of removal is dependent upon the use of the fraction. For instance, feed streams to catalytic reforming require extremely low sulfur concentrations (less than 1 wppm). Current EPA regulations call for combustible motor fuels such as gasoline, kerosene or diesel to have no more than about 500 wppm sulfur. It is expected that in the future the sulfur specification will be lowered to about 50 wppm, especially for gasoline.

The most common method of removal of the sulfur compounds is by hydrodesulfurization (HDS) in which the petroleum distillate is passed over a solid particulate catalyst comprising a hydrogenation metal supported on an alumina base. In the past this has generally been done by downflow or upflow over fixed beds concurrently with copious quantities of hydrogen at high pressure in the feed. The following equations illustrate the reactions in a prior art typical HDS unit:

(1) $RSH+H_2 \rightarrow RH+H_2S$ (2) $RCl+H_2 \rightarrow RH+HCl$ (3) $2RN+4H_2 \rightarrow RH+NH_3$ Additional reactions depend upon the sulfur compounds present and the source of the fraction. The catalyst used for hydrodesulfurization necessarily is a hydrogenation catalyst and the support sometimes is acidic in nature. The latter characteristics provide for some hydrocracking and hydrogenation of unsaturated compounds. The hydrocracking results in a higher volume of a less dense (lower specific gravity) material than the feed. Typical operating conditions for the prior art HDS reactions are:

| | |
|---|---|
| Temperature, °F. | 500–780 |
| Pressure, psig | 350–3000 |
| $H_2$ recycle rate, SCF/bbl | 600–3000 |
| Fresh $H_2$ makeup, SCF/bbl | 350–1000 |

After the hydrotreating is complete the product is fractionated, stripped or simply flashed to release the hydrogen sulfide, recover the hydrogen and collect the now sweetened fraction.

It should be noted that the conditions or severity of the operation will depend upon the sulfur compounds present and the degree of desulfurization desired. For instance mercaptans are much more easily desulfurized than thiophenes. The desulfurization of thiophenes and other heterocyclic sulfur compounds necessarily involves breaking and saturation of the rings which requires higher severity.

Recently there has been developed an alternative to the standard downflow trickle bed reactor. A distillation column reactor has been utilized wherein a solid particulate catalyst has been placed within a distillation column so as to act as a distillation structure. The distillation column reactor has been found to be particularly useful in equilibrium limited reactions because the reaction products have been removed from the reaction zone almost immediately. A particular example of such a usage is in the production of methyl tertiary butyl ether as disclosed in U.S. Pat. No. 4,232,177 or in the isomerization of butenes as disclosed in U.S. Pat. No. 5,087,780. Additionally the distillation column reactor has been found to be useful to prevent unwanted side reactions as in the alkylation of aromatics disclosed in U.S. Pat. No. 5,243,115.

Chen, et al in U.S. Pat. No. 4,194,964 disclose the use of concurrent distillation and hydroprocessing of heavy petroleum fractions such as atmospheric tower bottoms or a vacuum gas oil in a distillation column reactor. Chen, et al use high total pressures (around 1000 psi), high temperatures (around 850° F.), high hydrogen partial pressures (generally over 150 psi) and high hydrogen flow rates (around 4000 SCF/B) to achieve the desired conversions. In particular Chen, et al achieve a separation with an overhead distillate and a bottoms residuum to take the place of a normal crude oil vacuum distillation column.

SUMMARY OF THE INVENTION

Briefly the invention relates to a process wherein various side streams from a distillation unit are hydrotreated in separate reactors, preferably distillation column reactors with the $H_2S$ containing gas being returned to the crude distillation unit. In one embodiment crude oil is processed in the distillation unit. In another embodiment the invention relates to a process wherein the effluent from an FCCU is first treated in a primary distillation column reactor where various side streams are simultaneously produced. The side streams, especially the light cycle oil and heavy cycle oil are subjected to further hydrotreating in separate secondary distillation column reactors with the $H_2S$ containing gas being returned to the primary distillation column reactor.

In the preferred embodiment the present invention uses catalytic distillation in hydrodesulfurization at low total pressures in the range of 0 to 200 psig, low hydrogen partial pressure in the range of 0.01 to 70 psi and temperatures in the range of 400 ° to 800° F. Each side stream requiring hydrodesulfurization is passed to a separate distillation column reactor where the organic sulfur compounds are converted to hydrogen sulfide and concurrently separated from the hydrogen sulfide and unreacted hydrogen by fractional distillation. Due to the higher temperatures some hydrocracking and some hydrodenitrogenation may also occur. The overheads from each distillation column reactor containing the hydrogen sulfide, unreacted hydrogen and cracking products, if any, are returned to the crude distillation unit, preferably the atmospheric column. The unreacted hydrogen can assist in the stripping within the crude distillation unit.

DESCRIPTION OF THE PREFERRED EMBODIMENTS

Figure 1:
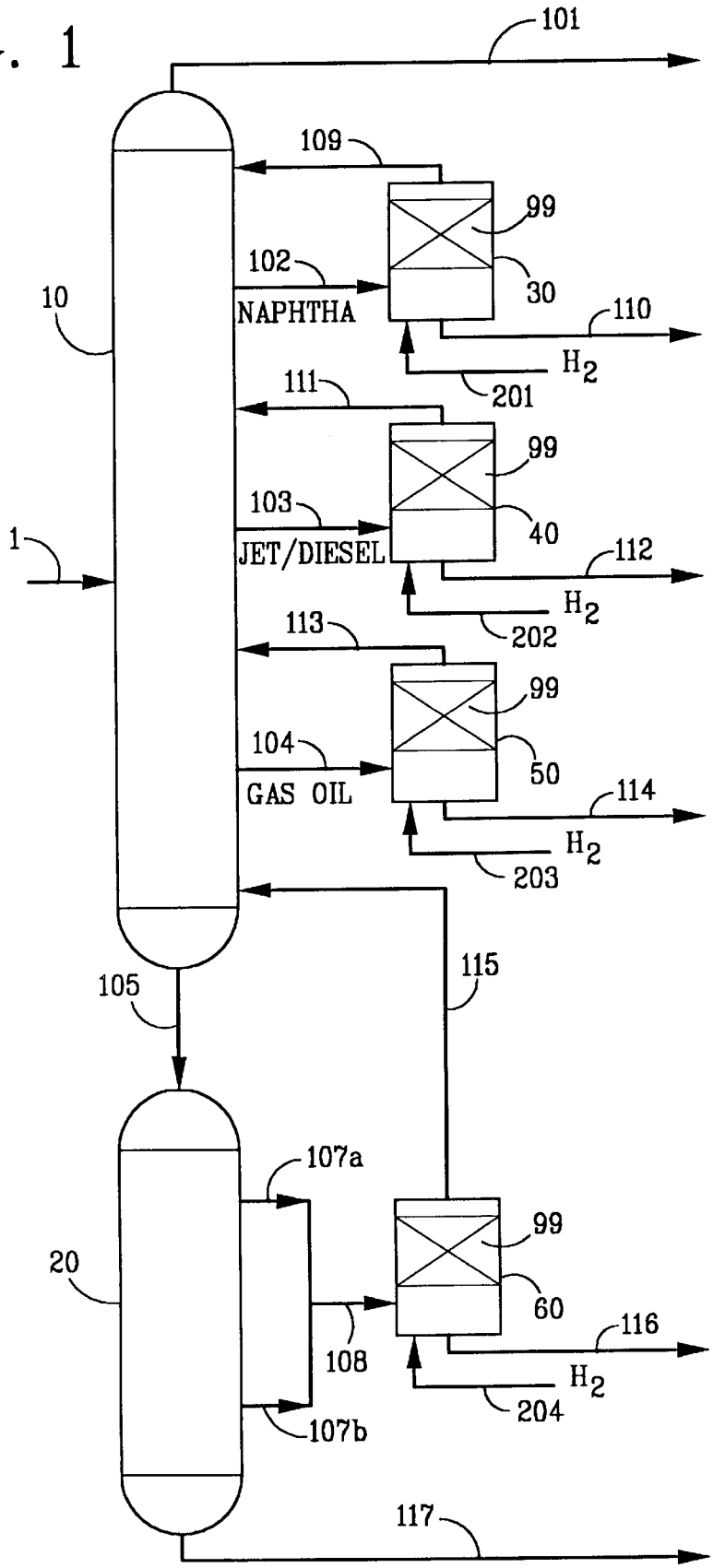
FIG. 1 is a flow diagram in schematic form of a preferred embodiment of the crude unit/hydrodesulfurization process of the present invention using crude feed and having catalytic distillation structures only in sidedraw stream columns.

The operation of a crude distillation unit having an atmospheric column and a vacuum column with various side stream draws is well known in the art. Some modifications will be necessary due to the unreacted hydrogen which flows back into the column from the hydrodesulfurization reactors.

In the preferred embodiment the operation of the distillation column reactors in the desulfurizations results in both a liquid and vapor phase within the distillation reaction zone. A considerable portion of the vapor is hydrogen while a portion is vaporous hydrocarbon from the petroleum fraction. Actual separation may only be a secondary consideration. Within the distillation reaction zone there is an internal reflux and liquid from an external reflux which cool the rising vaporous hydrocarbon condensing a portion within the bed.

It is believed that the mechanism that produces the effectiveness of the present process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation.

The result of the operation of the process in the catalytic distillation mode is that lower hydrogen partial pressures (and thus lower total pressures) may be used.

As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. Any higher boiling portion is subjected to higher temperatures in the lower end of the distillation column reactor to crack open the sulfur containing ring compounds and hydrogenate the sulfur. Finally, the upward flowing hydrogen acts as a stripping agent to help remove the $H_2S$ which is produced in the distillation reaction zone, shifting the equilibrium reactions.

The hydrogen rate to the distillation column reactor must be sufficient to maintain the reaction, but kept below that which would cause flooding of the column which is understood to be the "effectuating amount of hydrogen" as that term is used herein. The mole ratio of hydrogen to sulfur compound in the feed varies according to the type of compound and the amount of hydrogen expected to be consumed by side reactions such as double or triple bond saturation. Hydrogen flow rates are typically calculated as standard cubic feet per barrel of feed (SCFB) and are in the range of 50 to 3000 SCFB. Surprisingly, a low total pressure in the range of 0 to 200 psig is required for the hydrodesulfurization and hydrogen partial pressure of less than 70 psi down to 0.01 psi can be employed preferably about 0.5 to 10 psi.

Catalysts which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia, zeolites or the like.

Normally the metals are provided as the oxides of the metals supported on extrudates or spheres and as such are not generally useful as distillation structures.

Broadly stated, the catalytic material is preferably a component of a distillation system functioning as both a catalyst and distillation packing, i.e., a packing for a distillation column having both a distillation function and a catalytic function. The reaction system can be described as heterogenous since the catalyst remains a distinct entity.

A preferred catalyst structure for use in the distillation column reactors for the present hydrogenations comprises flexible, semi-rigid open mesh tubular material, such as stainless steel wire mesh, filled with a particulate catalytic material One new catalyst structure developed for use in hydrogenations is described in U.S. Pat. No. 5,266,546 which is incorporated herein in its entirety. Another catalyst structure particularly suited for hydrogenations is described in U.S. Pat. No. 5,431,890 which is incorporated herein in its entirety.

U.S. Pat. No. 4,242,530 and U.S. Pat. No. 4,443,559 which are incorporated herein, disclose supported catalyst in a plurality of pockets in a cloth belt or wire mesh tubular structures, which is supported in the distillation column reactor by open mesh knitted stainless steel wire by twisting the two together into a helix. U.S. Pat. No. 5,348,710, which is incorporated herein, describes several other suitable structures in the prior art and discloses new structures suitable for this process.

Other catalytic distillation structures useful for this purpose are disclosed in U.S. Pat. Nos. 4,731,229 and 5,073,236 which are also incorporated by reference.

In addition to the catalytic systems described above, reactive distillation systems such as those disclosed in U.S. Pat. Nos. 4,536,373, 4,774,364, 4,847,430 and 5,510,089, which are incorporated herein, may be used to carry out the present process.

The particulate catalyst material used in the distillation structures may be a powder, small irregular chunks or fragments, small beads and the like. The particular form of the catalytic material in the structure is not critical, so long as sufficient surface area is provided to allow a reasonable reaction rate. The sizing of catalyst particles can be best determined for each catalytic material (since the porosity or available internal surface area will vary for different material and of course affect the activity of the catalytic material).

For the present hydrodesulfurizations the preferred catalyst structures for the packing are those employing the more open structure of permeable plates or screen wire.

Catalysts suitable for the hydrodesulfurization reaction include cobalt-molybdenum, nickel-molybdenum and nickel-tungsten and zeolites. The metals are generally present as oxides supported on a neutral base such as alumina, silica-alumina or the like. The metals are reduced to the sulfide either in use or prior to use by exposure to sulfur compound containing streams. The properties of typical hydrodesulfurization catalyst are shown in Table I below.

TABLE I

| Manufacture | Criterion | Criterion |
|---|---|---|
| Designation | C-448 | C-411SM3 |
| Form | Trilobe Extrudate | |
| Nominal size | 1.2 mm | 1.2 mm |

TABLE I-continued

| Metal, Wt % | | |
|---|---|---|
| Cobalt | 2–5% | — |
| Molybdenum | 5–20% | 21.5% |
| Nickel | — | 3.5% |
| Support | alumina | alumina |

Referring now to FIG. 1 the process may be generally described. Crude petroleum oil is fed to the atmospheric distillation column 10 via flow line 1. The crude oil is separated into various boiling fractions by fractional distillation. Gas in the form of $C_4$ and lighter material along with $H_2S$ is removed from the atmospheric column (generally operated at 0 to 50 psig) as overheads via flow line 101 and may be subjected to further treatment to remove the $H_2S$ and concentrate the other gases. According to the present invention, the various side streams have been desulfurized and the sulfur (as $H_2S$) separated from each of the hydrotreated side streams is recovered in a single operation from the atmospheric column.

In this embodiment the catalyst is located only in the sidedraw stream columns. As in any distillation the lighter components are removed toward the upper end of the column and a bottoms is taken. Naphtha is removed via flow line 102 and fed to a first distillation column reactor 30 containing a typical hydrodesulfurization catalyst prepared as a distillation structure 99. Hydrogen is fed to reactor 30 preferably below the catalyst bed via flow line 201. Treated naphtha is withdrawn typically as bottoms via flow line 110 and gaseous products such as unreacted hydrogen and $H_2S$ are removed as overheads and returned via flow line 109 to the atmospheric column 10 preferably several trays above the side draw point.

A jet fuel/diesel boiling range fraction is withdrawn via flow line 103 and fed to a second distillation column reactor 40 also containing a typical hydrodesulfurization catalyst prepared as indicated above. The catalyst may the same or selected particularly for jet fuel/diesel. Hydrogen is fed preferably below the bed via flow line 202. Treated jet fuel/diesel is typically withdrawn as bottoms via flow line 112 and gaseous products such as unreacted hydrogen and $H_2S$ are removed as overheads and returned via flow line 111 to the atmospheric column 10 preferably several trays above the side draw point. Any cracked product will be returned also and naphtha in the cracked product will be withdrawn with the other naphtha via flow line 102.

A gas oil boiling range fraction is withdrawn via flow line 104 and fed to a third distillation column reactor 50 also containing a typical hydrodesulfurization catalyst prepared as indicated above. Again the catalyst may the same or selected particularly for gas oil service.

Hydrogen is fed to the reactor 50 preferably below the bed via flow line 203. Treated gas oil is typically withdrawn as bottoms via flow line 114 and gaseous products such as unreacted hydrogen and $H_2S$ are removed as overheads and returned via flow line 113 to the atmospheric column lo preferably several trays above the side draw point. Any light product will be returned also and naphtha in the light product will be withdrawn with the other naphtha via flow line 102 and jet fuel/diesel in the cracked product withdrawn via flow line 103.

The bottoms from the atmospheric column are fed to a vacuum column 20 as is standard wherein two side draws of vacuum gas oil are withdrawn via flow lines **107*a*** and

107*b*and combined into flow line 108 and fed to a fourth distillation column reactor 60 containing a gas oil hydrodesulfurization catalyst prepared as indicated above. Hydrogen is fed below the catalyst bed via flow line 204. Due to the nature of the vacuum gas oil and the temperature in the reactor 60 considerable cracking is expected. The cracked products along with unreacted hydrogen and the $H_2S$ are all removed as overheads and fed back to the lower end of the atmospheric column 10 via flow line 115. The treated vacuum gas oil is typically withdrawn as bottoms via flow line 116.

Finally the vacuum residuum is withdrawn as bottoms from the vacuum column via flow line 117.

All of the distillation column reactors show only an overheads and bottoms, but each could be configured as desired with individual side draws. For example, although not shown, the jet fuel/diesel reactor could be configured as a splitter with a side draw for the jet fuel and the diesel taken as bottoms.

Figure 2:
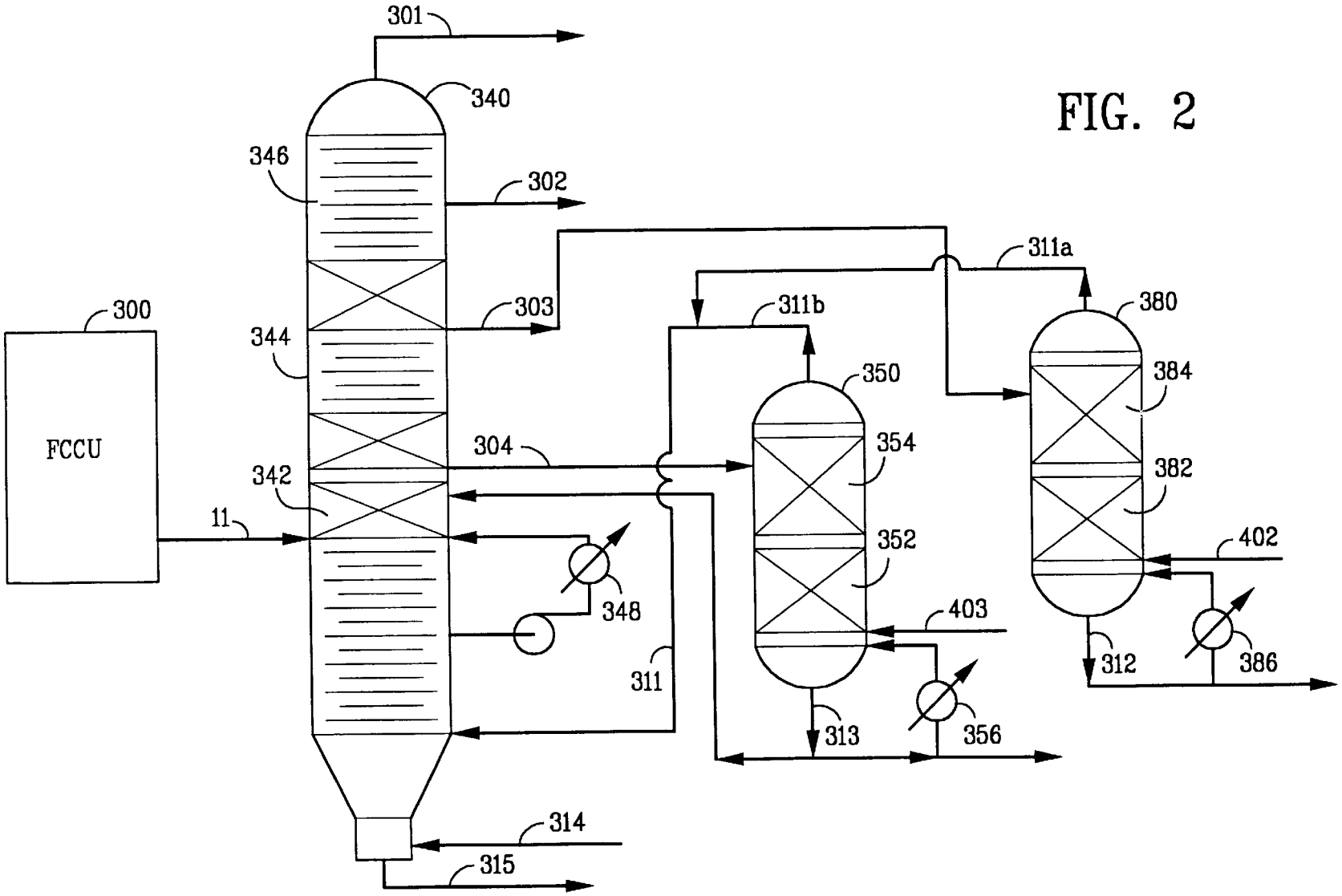
FIG. 2 is a flow diagram in schematic form of the preferred embodiment of the crude unit/hydrodesulfurization process of the present invention using FCCU feed.

Referring now to FIG. 2 the process may be generally described. Effluent from the FCCU reactor 300 is partially condensed and fed to a first distillation column reactor 340 via flow line 11. The first or primary distillation column 340 reactor contains a plurality of distillation reaction zones 342, 344 and 346. The primary distillation column reactor 340 includes a slurry belt desuperheater and catalyst wash out 348 in the lower section. The slurry belt desuperheater cools the fluid and removes the catalyst fines carried over from the FCCU.

The distillation reaction zones containing suitable hydrotreating catalyst in the form of distillation structures are all above the slurry belt to insure that all of the FCCU catalyst fines are removed prior to the FCCU products being exposed to the hydrotreating catalyst. The FCCU product is separated into various boiling fractions by fractional distillation. Gas in the form of $C_4$ and lighter material along with $H_2S$, $NH_3$, CO, $CO_2$ and water is removed from the primary column 340 as overheads via flow line 301 and may be subjected to further treatment to remove the $H_2S$ and concentrate the other gases. According to the present invention, the various side streams have been desulfurized and the sulfur (as $H_2S$) separated from each of the hydrotreated side streams is recovered in a single operation from the primary column.

Generally the distillation reaction zones in the primary column are kept below the point in the column where the material is boiling at 450° F. as this seems to be the lowest temperature at which the hydrotreating catalysts are effective. Hydrogen is fed at the lower end of the primary column as a stripping medium via flow line 314 and to provide the necessary hydrogen for the hydrotreating reactions.

As in any distillation the lighter components are removed toward the upper end of the column and a bottoms is taken. Heavy fluid catalytically cracked gasoline is removed via flow line 302 and taken as product. The gasoline may be further processed as desired. Typically the catalyst used in the primary column is a cobalt molybdenum supported on alumina. These catalysts are highly nitrogen and sulfur resistant besides acting as the hydrotreating component.

A light cycle oil (LCO) boiling range fraction is withdrawn via flow line 303 and fed to a first secondary distillation column reactor 380 also containing a typical hydrodesulfurization catalyst prepared as indicated above. The secondary distillation column reactor may contain two beds of catalyst. The lower bed 382 containing a cobalt nickel catalyst supported on alumina and the upper bed 384 a cobalt molybdenum catalyst supported on alumina. The second distillation column reactor acts as a reboiled LCO stripper having a reboiler 386. The two catalyst serve a dual function—hydrodesulfurization/hydrodenitrogenation and hydrogenation of the highly unsaturated compounds. In addition to saturating the highly unsaturated compounds any aromatics contained within the LCO may also be saturated. Hydrogen is fed preferably below the bed via flow line 402. Treated LCO is typically withdrawn as bottoms via flow line 312 with a portion being heated in reboiler 386 and returned to the column 380. Gaseous products such as unreacted hydrogen and $H_2S$ are removed as overheads and returned via flow line 311*a* to the atmospheric column 340 preferably near the bottom to add to the stripping action. Any cracked product will be returned also and naphtha in the cracked product will be withdrawn with the other naphtha via flow line 302. The treated LCO may be considered product (as heating oil) or returned to the FCCU reactor for further cracking.

A heavy cycle oil (HCO) boiling range fraction is withdrawn via flow line 304 and fed to a second secondary distillation column reactor 350 acting as a reboiled HCO stripper also containing a typical hydrodesulfurization catalyst prepared as indicated above. Again there are two catalyst beds which may the same or selected particularly for HCO service. In the embodiment shown the lower bed 352 is an alumina supported nickel molybdenum for the hydrogenation of highly unsaturated materials and the upper bed 354 is an alumina supported cobalt molybdenum catalyst for desulfurization. Hydrogen is fed to the reactor 350 preferably below the bed via flow line 403. Treated gas oil is typically withdrawn as bottoms via flow line 313 with a portion being heated in reboiler 356 and returned to the distillation column reactor 350. Gaseous products such as unreacted hydrogen and $H_2S$ are removed as overheads via flow line 311*b* and combined with the overheads from the LCO treater and returned via flow line 311 to the atmospheric column 340. Any light product will be returned also and naphtha in the light product will be withdrawn with the other naphtha via flow line 302 and jet LCO in the cracked product withdrawn via flow line 303. As with the LCO the HCO may be considered as product or recycled to the FCCU reactor for further cracking.

The bottoms from the primary column 340 are withdrawn via flow line 315 as decant oil which may be used in fuel oil blending or returned to the FCCU reactor for further cracking to lighter products.

Figure 3:
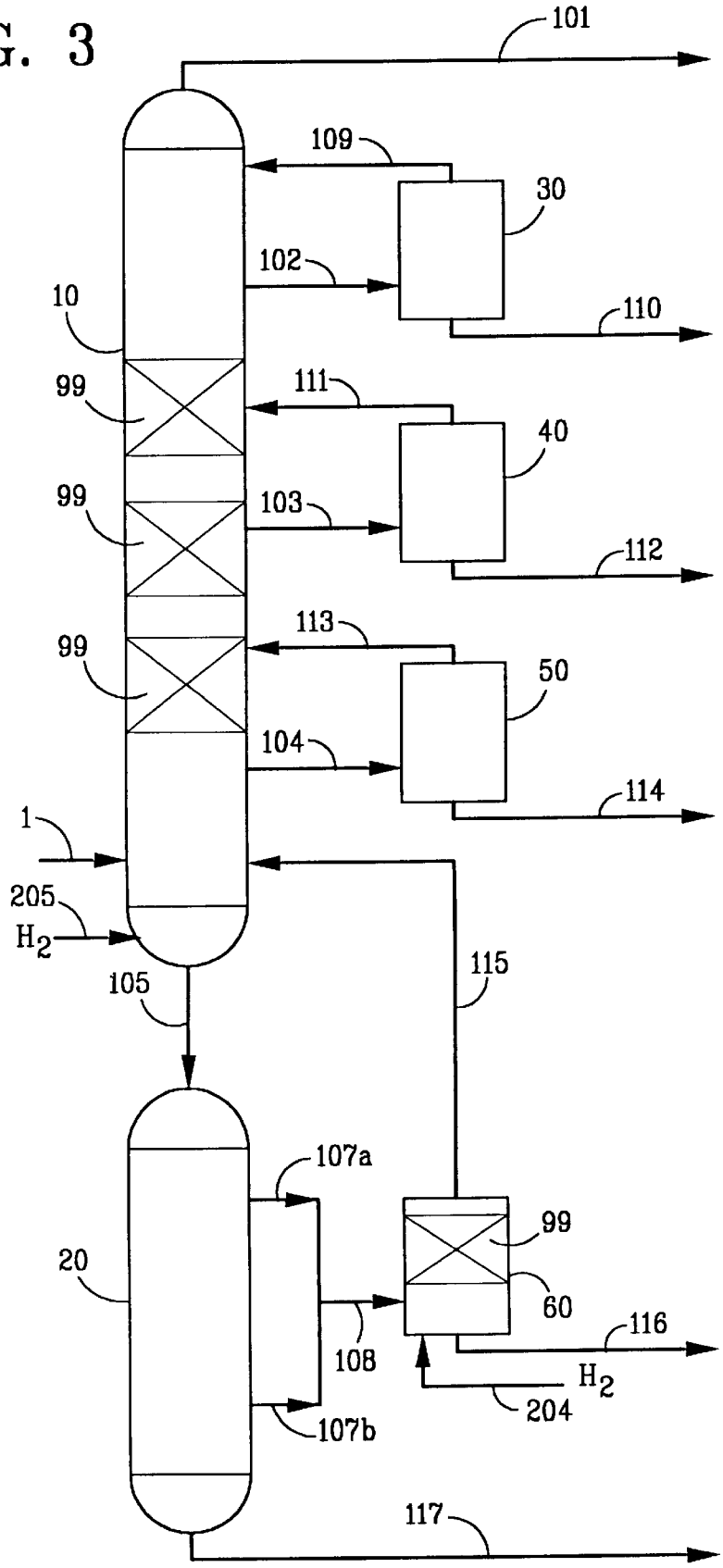
FIG. 3 is a flow diagram in schematic form of a preferred embodiment of the crude unit/hydrodesulfurization process of the present invention using crude feed and having catalytic distillation structures only in the atmospheric column.

The system in FIG. 3 is the same as in FIG. 1, except that the catalyst structures 99 have been removed from the side draw stream columns 30, 40 and 50 and placed in the atmospheric column, which continue to serve as distillation columns for the sidedraw streams. The hydrogen feed to the sidedraw stream columns have also been eliminated and hydrogen fed to the column 10 via line 205.

Figure 4:
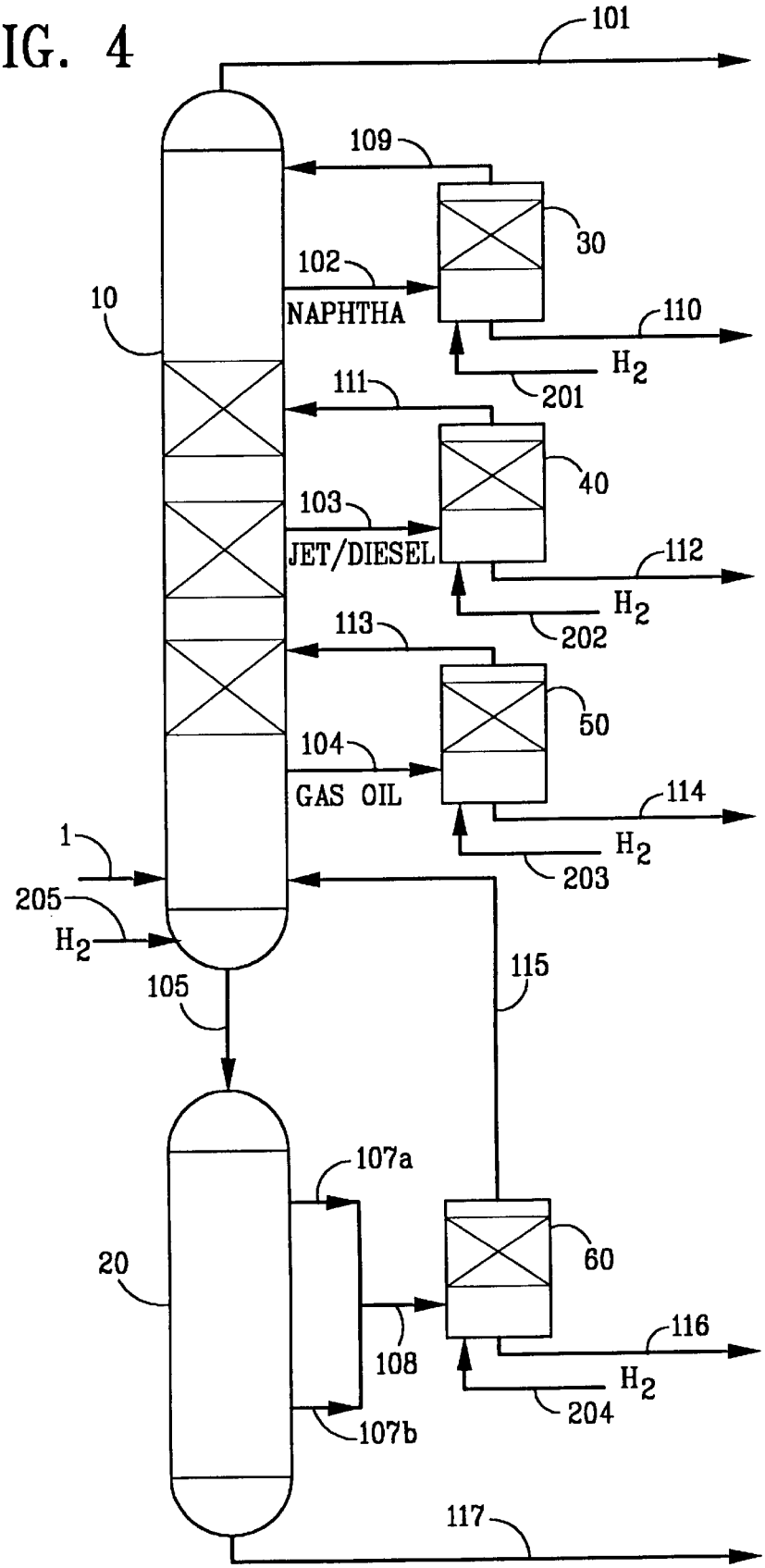
FIG. 4 is a flow diagram in schematic form of a preferred embodiment of the crude unit/hydrodesulfurization process of the present invention using crude feed and having catalytic distillation structures in both sidedraw stream columns and the atmospheric column.

In FIG. 4 the catalyst structures are located in both the sidedraw columns and the atmospheric column contains the catalyst structures 99.

Under the conditions of the present hydrodesulfurization, the treated streams also undergo hydrodenitrogenation.

The invention claimed is:

1. A process for hydrotreating petroleum fractions comprising the steps of:

(a) feeding a petroleum fraction containing organic sulfur compounds to an atmospheric distillation column wherein an overheads is taken, a bottoms is taken and at least one side stream is taken;

(b) feeding a portion of said side stream to a separate side column;

provided that at least one of said columns contains a hydrodesulfurization catalyst wherein a portion of the organic sulfur contained in each of said side streams is reacted with hydrogen to form hydrogen sulfide and unreacted hydrogen;

(c) returning said hydrogen sulfide and unreacted hydrogen in said side column to said atmospheric column; and (d) recovering said side stream from said side column having less organic sulfur compounds than in step (b).

2. The process according to claim 1 comprising a plurality of side columns and side streams.

3. The process according to claim 2 wherein said hydrodesulfurization catalyst is located in at least one side column.

4. The process according to claim 2 wherein said hydrodesulfurization catalyst is located in at least one side column and said atmospheric column.

5. The process according to claim 2 wherein said hydrodesulfurization catalyst is located in said atmospheric column.

6. The process according to claim 1 wherein said hydrodesulfurization catalyst is prepared as a component of a distillation structure.

7. A process for refining crude petroleum comprising the steps of:

(a) feeding the crude petroleum containing organic sulfur compounds to an atmospheric distillation column wherein an overheads is taken, a bottoms is taken and a plurality of different boiling range side streams are taken;

(b) feeding a portion of each of said side streams and hydrogen to a separate side column containing a hydrodesulfurization catalyst wherein a portion of the organic sulfur contained in each of said side streams is reacted with hydrogen to form hydrogen sulfide;

(c) separating said hydrogen sulfide and unreacted hydrogen from said side streams by distillation;

(d) returning said hydrogen sulfide and unreacted hydrogen to said atmospheric column; and (e) recovering each said side stream having less organic sulfur compounds than in step (b).

8. The process according to claim 7 wherein in addition to reacting organic sulfur with hydrogen a portion of each of the side streams and gas oil is cracked to a lower boiling material and the lower boiling material is taken with the overheads from each of said separate side column and returned to said atmospheric distillation column.

9. A process for refining crude petroleum comprising the steps of:

(A) feeding the crude petroleum containing organic sulfur compounds to an atmospheric distillation column wherein an overheads is taken, a bottoms is taken and a plurality of different boiling range side streams are taken;

(B) feeding a portion of each of said side streams and hydrogen to a separate distillation column reactor containing a hydrodesulfurization catalyst in the form of a catalytic distillation structure wherein concurrently:

(i) a portion of the organic sulfur contained in each of said side streams is reacted with hydrogen to form hydrogen sulfide and (ii) said hydrogen sulfide and unreacted hydrogen are separated from said side streams by fractional distillation;

(C) removing the hydrogen sulfide and unreacted hydrogen from each of said separate distillation column reactors as overheads;

(D) removing, as bottoms from each of said distillation column reactors, a desulfurized stream having less organic sulfur than said side stream fed to each of said separate distillation column reactors; and (E) returning the overheads from each of separate distillation column reactors to said atmospheric column.

10. The process according to claim 9 further comprising the steps of:

(F) feeding the bottoms from said atmospheric distillation column to a vacuum distillation column where a vacuum gas oil is separated from the vacuum residuum;

(G) feeding the vacuum gas oil and hydrogen to a separate gas oil distillation column reactor containing a hydrodesulfurization catalyst in the form of a catalytic distillation structure wherein concurrently (i) a portion of the organic sulfur contained in said vacuum gas oil is reacted with hydrogen to form hydrogen sulfide and (ii) said hydrogen sulfide and unreacted hydrogen are separated from said gas oil by fractional distillation;

(H) removing the hydrogen sulfide and unreacted hydrogen from said gas oil distillation column reactor as overheads;

(i) removing a desulfurized vacuum gas oil less the reacted organic sulfur from said gas oil distillation column reactor as bottoms; and (I) returning the overheads from said gas oil distillation column reactor to said atmospheric distillation column.

11. The process according to claim 10 wherein in addition to reacting organic sulfur with hydrogen a portion of each of the side streams and gas oil is cracked to a lower boiling material and the lower boiling material is taken with the overheads from each of said separate distillation column reactors and returned to said atmospheric distillation column.

12. The process according to claim 9 wherein said side draw streams comprise a naphtha stream, a jet fuel/diesel stream and a gas oil stream.

13. The process according to claim 9 wherein the overheads from each of said separate distillation column reactors is returned to said atmospheric distillation column at a point above the tray from which the individual side stream was taken.

14. The process according to claim 10 wherein the overheads from said gas oil distillation column reactor is returned to said atmospheric distillation column near the bottom.

15. A process for refining crude petroleum comprising the steps of:

(A) feeding the crude petroleum containing organic sulfur compounds to an atmospheric distillation column wherein an overheads is taken, a bottoms is taken and a plurality of different boiling range side streams are taken;

(B) feeding each of said side streams and hydrogen to a separate distillation column reactor containing a hydrodesulfurization catalyst in the form of a catalytic distillation structure wherein concurrently:

(i) a portion of the organic sulfur contained in each of said side streams is reacted with hydrogen to form hydrogen sulfide and (ii) said hydrogen sulfide and unreacted hydrogen are separated from said side streams by fractional distillation;

(C) removing the hydrogen sulfide and unreacted hydrogen from each of said separate distillation column reactors as overheads;

(D) removing, as bottoms from each of said distillation column reactors, a desulfurized stream having less organic sulfur than said side stream fed to each of said separate distillation column reactors;

(E) returning the overheads from each of separate distillation column reactors to said atmospheric column;

(F) feeding the bottoms from said atmospheric distillation column to a vacuum distillation column where a vacuum gas oil is separated from the vacuum residuum;

(G) feeding the vacuum gas oil and hydrogen to a separate gas oil distillation column reactor containing a hydrodesulfurization catalyst in the form of a catalytic distillation structure wherein concurrently:

(i) a portion of the organic sulfur contained in said vacuum gas oil is reacted with hydrogen to form hydrogen sulfide and (ii) said hydrogen sulfide and unreacted hydrogen are separated from said gas oil by fractional distillation;

(H) removing the hydrogen sulfide and unreacted hydrogen from said gas oil distillation column reactor as overheads;

(I) removing a desulfurized vacuum gas oil less the reacted organic sulfur from said gas oil distillation column reactor as bottoms; and (J) returning the overheads from said gas oil distillation column reactor to said atmospheric distillation column.

16. The process according to claim 15 wherein said $H_2S$ is recovered as overheads from said atmospheric column.

17. A process for upgrading the effluent from a fluid catalytic cracking unit comprising the steps of:

(a) feeding hydrogen and the effluent from a fluid catalytic cracking reactor containing organic sulfur compounds to a primary distillation column reactor containing a plurality of beds of a hydrotreating catalyst in the form of a catalytic distillation structure wherein the effluent is simultaneously hydrotreated to remove sulfur and fractionated into a heavy fluid cracked gasoline, a light cycle oil and a heavy cycle oil;

(b) withdrawing the heavy fluid cracked gasoline from said primary distillation column reactor at a point near the top;

(c) withdrawing said light cycle oil and said heavy cycle oil separately and feeding each of said light cycle oil and heavy cycle oil to separate secondary distillation column reactors containing a hydrodesulfurization catalyst wherein a portion of the organic sulfur contained in each of said side streams is reacted with hydrogen to form hydrogen sulfide;

(d) separating said hydrogen sulfide and unreacted hydrogen from said light cycle oil and heavy cycle oil by distillation in said secondary distillation column reactors;

(e) returning said hydrogen sulfide and unreacted hydrogen to said primary column; and (f) recovering each said light cycle oil and heavy cycle oil having less organic sulfur compounds than in step (b).

18. The process according to claim 17 wherein in addition to reacting organic sulfur with hydrogen a portion of each of the light cycle oil and heavy cycle oil is cracked to a lower boiling material and the lower boiling material is taken with the overheads from each of said separate secondary distillation column reactors and returned to said atmospheric distillation column.

19. The process according to claim 17 wherein each of said secondary distillation column reactors contains a second bed of hydrogenation catalysts in the form of a catalytic distillation structure and a portion of the highly unsaturated compounds and aromatics contained within said light cycle oil and heavy cycle oil are saturated.

20. A process for refining crude petroleum comprising the steps of:

(a) feeding hydrogen and the effluent from a fluid catalytic cracking containing organic sulfur compounds to a primary distillation column reactor containing a plurality of beds of a hydrotreating catalyst in the form of a catalytic distillation structure wherein the effluent is simultaneously hydrotreated to remove sulfur and fractionated into an overheads, a bottoms and a plurality of different boiling range side streams comprising heavy fluid cracked gasoline, light cycle oil and heavy cycle oil;

(b) feeding each of said side streams and hydrogen to separate secondary distillation column reactors each containing a hydrodesulfurization catalyst in the form of a catalytic distillation structure wherein concurrently:

(i) a portion of the organic sulfur contained in each of said side streams is reacted with hydrogen to form hydrogen sulfide and (ii) said hydrogen sulfide and unreacted hydrogen are separated from said side streams by fractional distillation;

(c) removing the hydrogen sulfide and unreacted hydrogen from each of said separate distillation column reactors as overheads;

(d) removing, as bottoms from each of said separate secondary distillation column reactors, a desulfurized stream having less organic sulfur than said side stream fed to each of said separate distillation column reactors; and (e) returning the overheads from each of separate secondary distillation column reactors to said atmospheric column.

21. The process according to claim 20 wherein the overheads from each of said separate secondary distillation column reactors is returned to said primary distillation column reactor at a point near the bottom.

22. The process according to claim 20 wherein each of said secondary distillation column reactors contains a second bed of hydrogenation catalysts in the form of a catalytic distillation structure and a portion of the highly unsaturated compounds and aromatics contained within said light cycle oil and heavy cycle oil are saturated.

* * * * *